US008471497B2

(12) United States Patent
Ruan et al.

(10) Patent No.: US 8,471,497 B2
(45) Date of Patent: Jun. 25, 2013

(54) CONTROL CIRCUIT AND METHOD FOR LED DRIVERS

(75) Inventors: Chen-Jie Ruan, Shanghai (CN); Chin-Hui Wang, New Taipei (TW); Liang Mao, Shanghai (CN)

(73) Assignee: Richpower Microelectronics Corporation, Grand Cayman, British West Indies (KY)

( * ) Notice: Subject to any disclaimer, the term of this patent is extended or adjusted under 35 U.S.C. 154(b) by 226 days.

(21) Appl. No.: 13/081,074

(22) Filed: Apr. 6, 2011

(65) Prior Publication Data

US 2011/0254462 A1 Oct. 20, 2011

(30) Foreign Application Priority Data

Apr. 14, 2010 (CN) ..... 2010 1 0146431

(51) Int. Cl.
*G05F 1/00* (2006.01)
*H05B 37/02* (2006.01)
*H05B 39/04* (2006.01)
*H05B 41/36* (2006.01)

(52) U.S. Cl.
USPC ..... 315/307; 315/291; 315/294; 315/308

(58) Field of Classification Search
None
See application file for complete search history.

(56) References Cited

U.S. PATENT DOCUMENTS

2006/0043911 A1* 3/2006 Shao et al. ..... 315/291
2012/0062144 A1* 3/2012 Yao et al. ..... 315/294

* cited by examiner

*Primary Examiner* — Anh Tran
(74) *Attorney, Agent, or Firm* — Muncy, Geissler, Olds & Lowe, PLLC

(57) ABSTRACT

A control circuit and method for a LED driver accurately control the output current of the LED driver by adjusting a reference voltage or a feedback voltage according to the input voltage of the LED driver such that the output current decreases with the decrease of the input voltage. Therefore, it enhances the efficiency of the LED driver and maximizes the battery use time of a battery powered system.

13 Claims, 7 Drawing Sheets

CONTROL CIRCUIT AND METHOD FOR LED DRIVERS

FIELD OF THE INVENTION

The present invention is related generally to LED drivers and, more particularly, to a control circuit and method for LED drivers.

BACKGROUND OF THE INVENTION

Due to various advantageous characteristics of switching power converters, there have been developed many applications thereof, one of which is for LED drivers. In battery powered systems, for example LED flashlights, conventionally the input current is sensed and controlled in such a way that the lower the input power is the lower the input current is. Thus, LEDs can be lighted even when battery is almost exhausted and maximum utility time is realized. This method however has two major drawbacks: (1) In practice, the illumination of the LEDs is proportional to the output current instead of the input current, and thus the 'wrong' current is sensed and controlled; and (2) The input current is usually larger than the output current in a boost structure system, which makes this method not efficient, and considerable power is wasted on the current sense resistor.

For example, FIG. 1 shows a real application in which a boost structure LED driver 10 has a transistor Q acting as a power switch switched by a controller 12, and a current sense resistor R serially connected to the transistor Q for detecting the input current Iin to feed back to the controller 12. Once the voltage drop VR of the current sense resistor R is higher than a reference voltage, the transistor Q will be turned off for a constant time to release the energy stored in the inductor L. In this way, the peak current of the input current Iin is controlled. During the decrease of the input voltage Vin, the reference voltage drops at a constant slope to maximum the utility time of the battery. As mentioned above, the output current Io is not controlled and thus difficult to be determined. It will greatly change with external components and cause troubles for mass production. The efficiency is also hard to improve due to the large input current Iin flowing through the current sense resistor R.

SUMMARY OF THE INVENTION

An objective of the present invention is to provide a control circuit and method for LED drivers.

Another objective of the present invention is to provide a control circuit and method for high efficient LED drivers.

A further objective of the present invention is to provide a control circuit and method for long battery use time of a battery powered system.

According to the present invention, the input voltage of a LED driver is sensed to adjust the feedback voltage or the reference voltage thereof. Since the current in the driven LED is directly proportional to the feedback or reference voltage, the output current is accurately controlled. When the input voltage goes lower, the control circuit and method make the feedback voltage higher or the reference voltage lower to exhaust battery power. In this way, efficiency is enhanced while accurate control is realized. Also, maximum utility time of the battery is achieved.

BRIEF DESCRIPTION OF THE DRAWINGS

These and other objectives, features and advantages of the present invention will become apparent to those skilled in the art upon consideration of the following description of the preferred embodiments of the present invention taken in conjunction with the accompanying drawings, in which:

FIG. 3 is an embodiment for the reference voltage adjuster shown in

FIG. 2;

FIG. 5 is an embodiment for the feedback voltage adjuster shown in

FIG. 4;

DETAILED DESCRIPTION OF THE INVENTION

Figure 1:
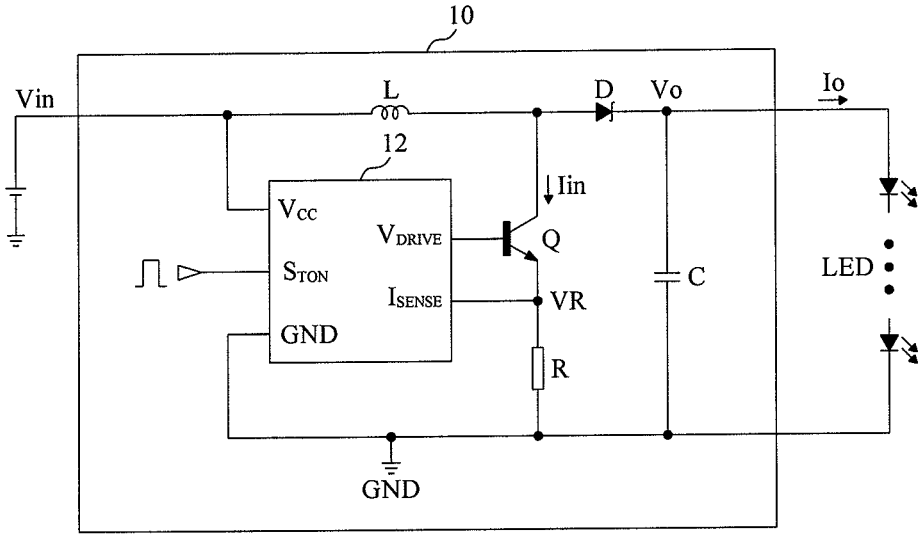
Fig. 1 Prior Art
FIG. 1 shows a conventional boost structure LED driver.
Figure 2:
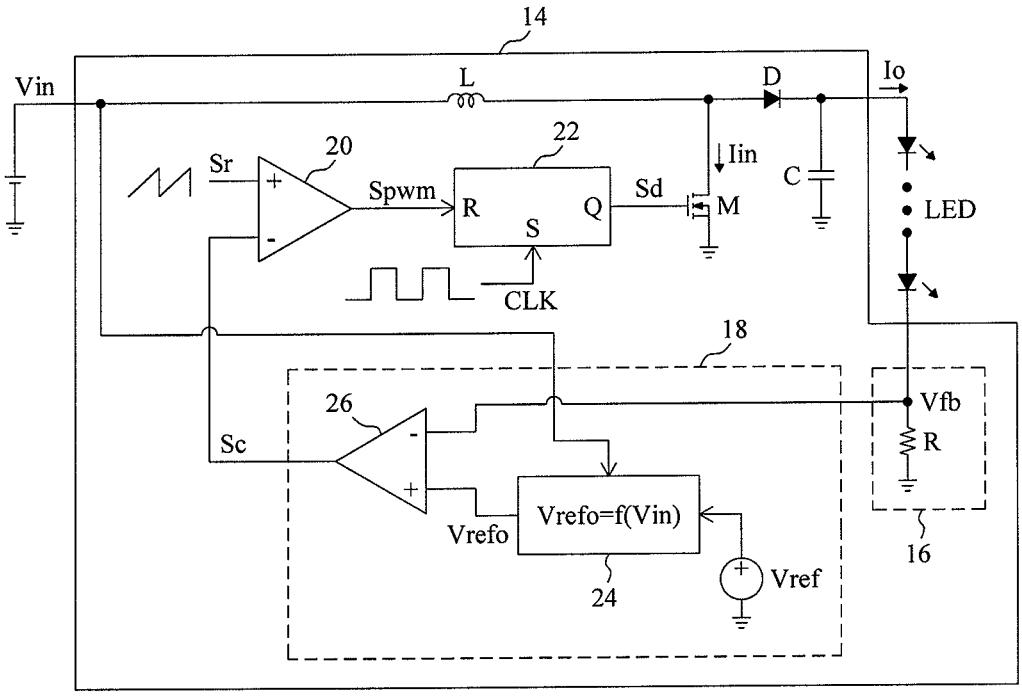
FIG. 2 is a boost structure LED driver using a first embodiment of the present invention.

Referring to FIG. 2 for a boost structure LED driver 14 according to the present invention, in which a feedback circuit 16 is connected to a LED string to feed back the LED current Io to a control circuit 18 by a feedback voltage Vfb, the control circuit 18 detects the input voltage Vin and generates an error signal Sc according to the feedback voltage Vfb, a pulse width modulation (PWM) comparator 20 compares the error signal Sc with a ramp signal Sr to generate a PWM signal Spwm, and a flip-flop 22 generates a driving signal Sd according to the PWM signal Spwm and a clock CLK to control a transistor M acting as a power switch to regulate the output current Io supplied to the LED string. In this embodiment, the feedback circuit 16 includes a current sense resistor R serially connected to the LED string for detecting the output current Io, and the feedback voltage Vfb is derived from the voltage drop of the current sense resistor R. In the control circuit 18, a voltage source Vref provides a reference voltage Vref for a reference voltage adjuster 24, the reference voltage adjuster 24 detects the input voltage Vin and adjusts the reference voltage Vref into Vrefo=f(Vin) accordingly, which decreases with the input voltage Vin decreased, and an error amplifier 26 generates the error signal Sc according to the difference between the feedback voltage Vfb and the reference voltage Vrefo. In this way, the negative feedback loop will force the feedback voltage Vfb to equal to the reference voltage Vrefo. Particularly, when the reference voltage Vrefo decreases, the output current Io decreases correspondingly. In a battery powered system, when the battery voltage Vin decreases, the output current Io decreases correspondingly, so the battery use time will be longer.

Figure 3:
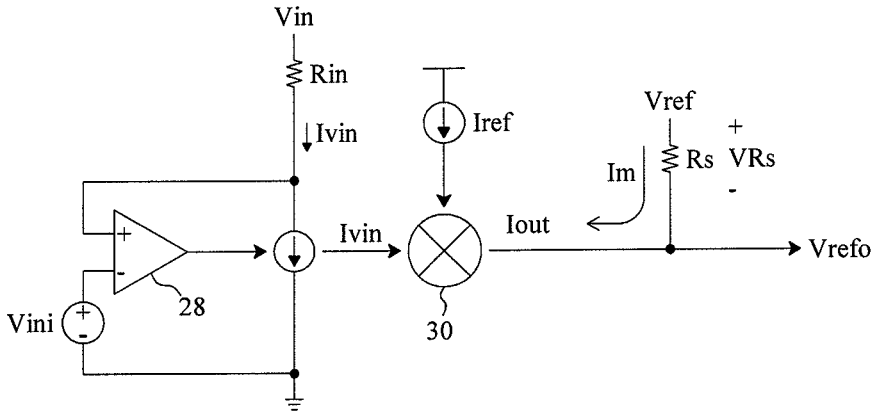

FIG. 3 is an embodiment for the reference voltage adjuster 24 shown in FIG. 2, in which a voltage source Vini provides a reference voltage Vini to a negative input terminal of an operational amplifier 28, a resistor Rin is connected between the power input terminal Vin and a positive input terminal of the operational amplifier 28, the operational amplifier 28 will reflect the reference voltage Vini to its positive input terminal due to virtual short between the input terminals thereof, thus the resistor Rin has a current Ivin=(Vin−Vini)/Rin, the current Ivin is sent to an operational circuit 30 to operate with the current Ivin and a reference current Iref, for example to add, subtract, multiply or divide therewith, to generate a current Im=f(−Ivin) for a resistor Rs connected between the voltage source Vref and an output terminal Tout of the operational circuit 30 to receive to generate an adjust voltage VRs thereacross, and by subtracting the adjust voltage VRs from the reference voltage Vref, it produces the reference voltage Vrefo=Vref−Im×Rs. When the input voltage Vin decrease, the current Im increases, and the adjust voltage VRs becomes larger, so the reference voltage Vrefo decreases.

Figure 4:
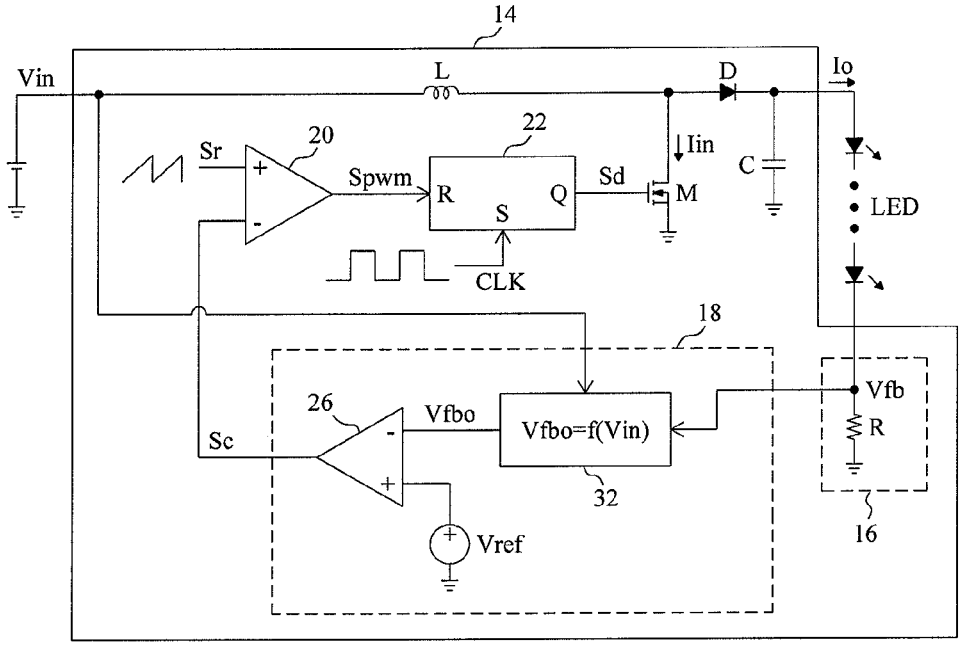
FIG. 4 is a boost structure LED driver using a second embodiment of the present invention.

In an error amplifier, a decrease at a positive input is equal to an increase at a negative input. Thus, the embodiment of FIG. 2 may be modified into another embodiment as shown in FIG. 4, in which a feedback voltage adjuster 32 detects the input voltage Vin and adjusts the feedback voltage Vfb into Vfbo=f(Vin) accordingly, which increases when the input voltage Vin decreases. In this embodiment, the negative feedback loop will force the feedback voltage Vfbo to equal to the reference voltage Vref. Particularly, when the feedback voltage Vfbo increases, the output current Io decreases correspondingly. In other words, the output current Io decreases with the input voltage Vin decreased. As a result, in a battery powered system, the battery use time will be longer.

Figure 5:
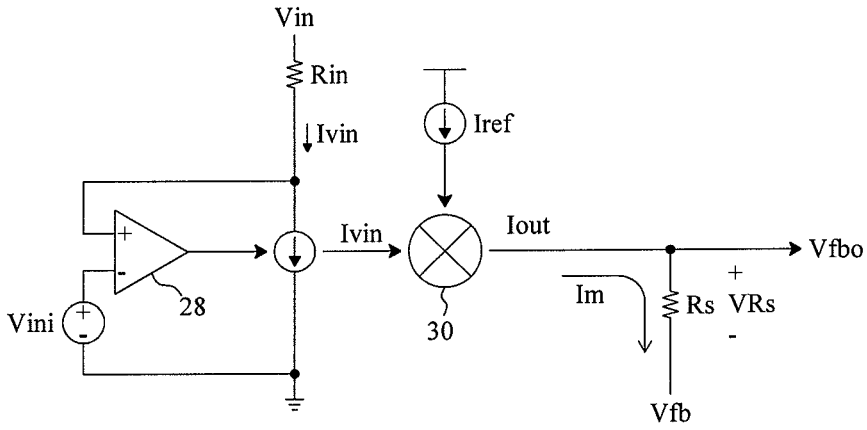

FIG. 5 is an embodiment for the feedback-voltage adjuster 32 shown in FIG. 4, which has a circuit identical to that of FIG. 3, but with the resistor Rs connected between the output terminal Tout of the operational circuit 30 and the feedback circuit 16. By adding the adjust voltage VRs to the feedback voltage Vfb, it produces the feedback voltage Vfbo=Vfb+Im×Rs. Due to the current Im=f(−Ivin), when the input voltage Vin decrease, the current Im increases, the adjust voltage VRs increases, and the feedback voltage Vfbo increases.

Figure 6:
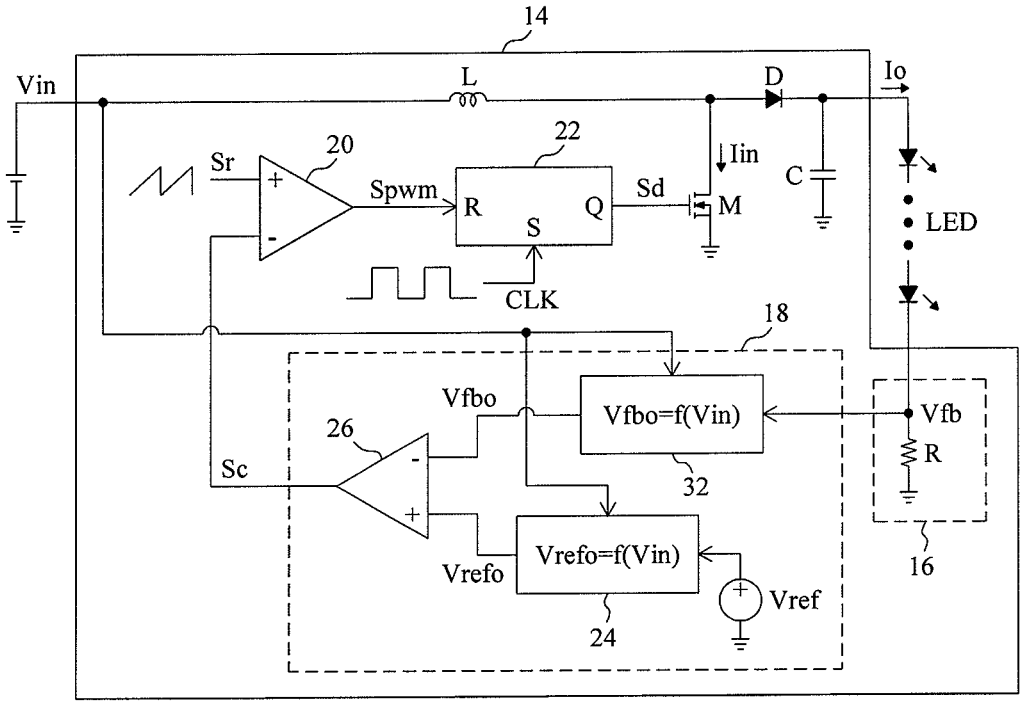
FIG. 6 is a boost structure LED driver using a third embodiment of the present invention.

The embodiments of FIG. 2 and FIG. 4 may be combined, as shown in FIG. 6, in which the reference voltage adjuster 24 and the feedback voltage adjuster 32 adjust the reference voltage Vref and the feedback voltage Vfb into Vrefo=f(Vin) and Vfbo=f(Vin), respectively, the reference voltage Vrefo decreases when the input voltage Vin decreases, the feedback voltage Vfbo decreases when the input voltage Vin increases, the negative feedback loop forces the feedback voltage Vfbo to equal to the reference voltage Vrefo, and thus, when the feedback voltage Vfbo increases or when the reference voltage Vrefo decrease, the output current Io decreases accordingly.

In the embodiments of FIG. 2, FIG. 4 and FIG. 6, the output current Io is smaller than the input current Iin, so the power consumption of the current sense resistor R is less, and thus the efficiency is higher. For LED drivers according to the present invention, it is the output current Io being detected and controlled, and thus the illumination of the driven LEDs can be accurately controlled.

Figure 7:
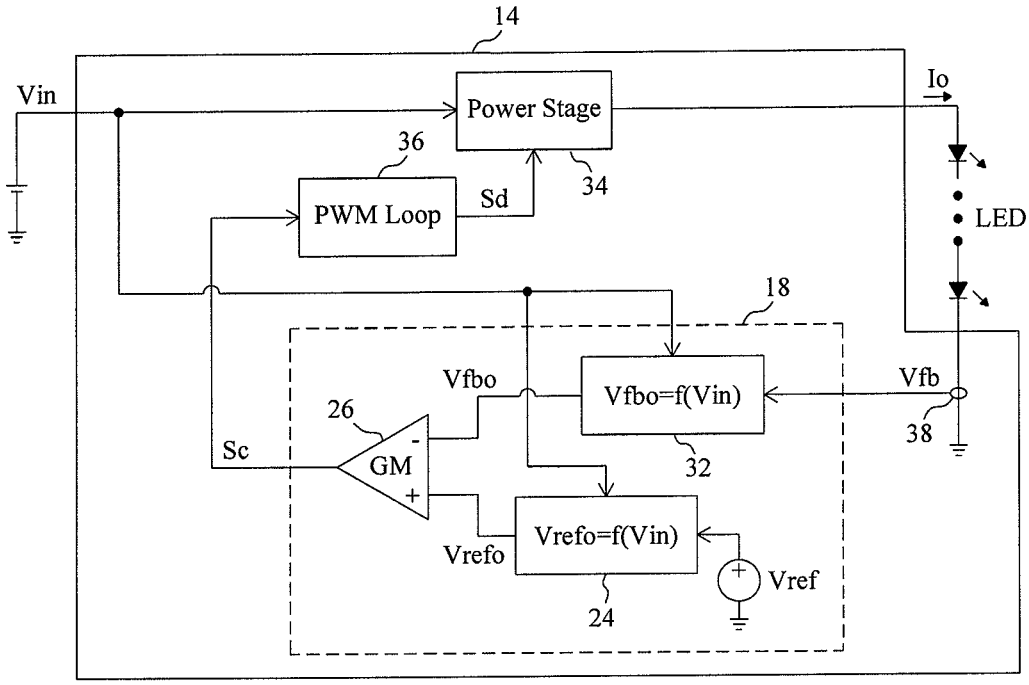
FIG. 7 is a boost structure LED driver using a fourth embodiment of the present invention.

The above embodiments recite specific power converters and circuits only for the sake of illustration of the principle and scope of the present invention, and are not intended to be any limitation to the present invention. For example, referring to FIG. 7, a power stage 34 and a PWM loop 36 of a power converter may be provided with different types and circuits, such as of a buck structure and a low dropout (LDO) structure, the error signal Sc provided to the PWM loop 36 may be in the form of a current instead, and in such a case, the error amplifier 26 may be a transconductance amplifier. There have been also various methods and circuits for the detector 38 to detect a LED current Io to generate the feedback voltage Vfb, for example, from the output terminal of the power stage 34. Taught by the above embodiments, those skilled in the art would learn to apply the present invention to various LED drivers and devise other embodiments by using different circuit designs depending on demands.

What is claimed is:

1. A control circuit for a LED driver having a feedback circuit detecting an output current of the LED driver to generate a feedback voltage, the control circuit comprising:

a reference voltage adjuster connected to a power input terminal of the LED driver, detecting an input voltage of the LED driver and adjusting a first reference voltage accordingly, to thereby generate a second reference voltage; and an error amplifier connected to the feedback circuit and the reference voltage adjuster, generating an error signal according to a difference between the feedback voltage and the second reference voltage, for controlling the output current;

wherein the reference voltage adjuster comprises:

a first resistor configured to determine a first current according to a difference between the input voltage and a third reference voltage;

an operational circuit operating with the first current and a reference current to generate a second current; and a second resistor connected to the operational circuit, configured to generate an adjust voltage according to the second current;

wherein the second reference voltage is derived by subtracting the adjust voltage from the first reference voltage.

2. The control circuit of claim 1, wherein the error amplifier comprises a transconductance amplifier.

3. A control method for a LED driver having a feedback circuit detecting an output current of the LED driver to generate a feedback voltage, the control method comprising the steps of:

(A) detecting an input voltage of the LED driver and adjusting a first reference voltage accordingly, to thereby generate a second reference voltage; and (B) generating an error signal according to a difference between the feedback voltage and the second reference voltage, for controlling the output current;

wherein the step A comprises the steps of:

determining a first current according to a difference between the input voltage and a third reference voltage;

operating with the first current and a reference current to generate a second current;

generating an adjust voltage according to the second current; and subtracting the adjust voltage from the first reference voltage to generate the second reference voltage.

4. A control circuit for a LED driver having a feedback circuit detecting an output current of the LED driver to generate a first feedback voltage, the control circuit comprising:

a feedback voltage adjuster connected to the feedback circuit and a power input terminal of the LED driver, detecting an input voltage of the LED driver and adjusting the first feedback voltage accordingly, to thereby generate a second feedback voltage; and an error amplifier connected to the feedback voltage adjuster, generating an error signal according to a difference between the second feedback voltage and a first reference voltage, for controlling the output current;

wherein the feedback voltage adjuster comprises:

a first resistor configured to determine a fast current according to difference between the input voltage and a second reference voltage;

an operational circuit operating with the first current and a reference current to generate a second current; and a second resistor connected to the operational circuit, configured to generate an adjust voltage according to the second current;

wherein the second feedback voltage is derived by adding the adjust voltage to the first feedback voltage.

5. The control circuit of claim 4, wherein the error amplifier comprises a transconductance amplifier.

6. A control method for a LED driver having a feedback circuit detecting an output current of the LED driver to generate a first feedback voltage, the control method comprising the steps of:

(A) detecting an input voltage of the LED driver and adjusting the first feedback voltage accordingly, to thereby generate a second feedback voltage; and (B) generating an error signal according to a difference between the second feedback voltage and a first reference voltage, for controlling the output current;

wherein the step A comprises the steps of:

determining a first current according to a difference between the input voltage and a second reference voltage;

operating with the first current and a reference current to generate a second current;

generating an adjust voltage according to the second current; and adding the adjust voltage to the first feedback voltage to generate the second feedback voltage.

7. A control circuit for a LED driver having a feedback circuit detecting an output current of the LED driver to generate a first feedback voltage, the control circuit comprising:

a reference voltage adjuster connected to a power input terminal of the LED driver, detecting an input voltage of the LED driver and adjusting a first reference voltage accordingly, to thereby generate a second reference voltage; and a feedback voltage adjuster connected to the feedback circuit and a power input terminal of the LED driver, detecting the input voltage and adjusting the first feedback voltage accordingly, to thereby generate a second feedback voltage; and an error amplifier connected to the reference voltage adjuster and the feedback voltage adjuster, generating an error signal according to a difference between the second feedback voltage and the second reference voltage, for controlling the output current.

8. The control circuit of claim 7, wherein the reference voltage adjuster comprises:

a first resistor configured to determine a first current according to a difference between the input voltage and a third reference voltage;

an operational circuit operating with the first current and a reference current to generate a second current; and a second resistor connected to the operational circuit, configured to generate an adjust voltage according to the second current;

wherein the second reference voltage is derived by subtracting the adjust voltage from the first reference voltage.

9. The control circuit of claim 7, wherein the feedback voltage adjuster comprises:

a first resistor configured to determine a first current according to a difference between the input voltage and a third reference voltage;

an operational circuit operating with the first current and a reference current to generate a second current; and a second resistor connected to the operational circuit, configured to generate an adjust voltage according to the second current;

wherein the second feedback voltage is derived by adding the adjust voltage to the first feedback voltage.

10. The control circuit of claim 7, wherein the error amplifier comprises a transconductance amplifier.

11. A control method for a LED driver having a feedback circuit detecting an output current of the LED driver to generate a first feedback voltage, the control method comprising the steps of:

(A) detecting an input voltage of the LED driver and adjusting a first reference voltage accordingly, to thereby generate a second reference voltage;

(B) detecting the input voltage and adjusting the first feedback voltage accordingly, to thereby generate a second feedback voltage; and (C) generating an error signal according to a difference between the second feedback voltage and the second reference voltage, for controlling the output current.

12. The control method of claim 11, wherein the step A comprises the steps of:

determining a first current according to a difference between the input voltage and a third reference voltage;

operating with the first current and a reference current to generate a second current;

generating an adjust voltage according to the second current; and subtracting the adjust voltage from the first reference voltage to generate the second reference voltage.

13. The control method of claim 11, wherein the step B comprises the steps of:

determining a first current according to a difference between the input voltage and a third reference voltage;

operating with the first current and a reference current to generate a second current;

generating an adjust voltage according to the second current; and adding the adjust voltage to the first feedback voltage to generate the second feedback voltage.

* * * * *